United States Patent [19]

Dabney

[11] 3,950,889

[45] Apr. 20, 1976

[54] PRESSURIZED GAS DRIVEN VEHICLE AND METHODS FOR CHARGING AND LAUNCHING IT

[76] Inventor: William C. Dabney, 32-09 108th St., East Elmhurst, N.Y. 11369

[22] Filed: Apr. 3, 1975

[21] Appl. No.: 564,804

[52] U.S. Cl. ..... 46/44; 46/206; 46/236; 46/45; 273/86 R

[51] Int. Cl.[2] ..... A63F 9/14

[58] Field of Search ..... 46/44, 74 A, 74 B, 74 C, 46/95, 206; 273/86 R

[56] References Cited

UNITED STATES PATENTS

| | | | |
|---|---|---|---|
| 2,410,682 | 11/1946 | Richardson | 46/76 A X |
| 2,545,586 | 3/1951 | Pollak | 46/76 A |
| 3,577,677 | 5/1971 | Bennett et al. | 46/206 |
| 3,844,557 | 10/1974 | Pompetti | 273/86 R |

FOREIGN PATENTS OR APPLICATIONS

| | | | |
|---|---|---|---|
| 494,675 | 5/1954 | Italy | 46/44 |

*Primary Examiner*—F. Barry Shay
*Attorney, Agent, or Firm*—St. Onge Mayers Steward & Reens

[57] ABSTRACT

A pressurized gas driven vehicle, such as a toy automobile, comprises a body which defines a pressure chamber for confining pressurized gas. A nozzle is mounted on the body and has a jet outlet passage which communicates with the pressure chamber. An electrically conductive seal, which disintegrates when sufficiently large electric current is passed through it, is attached to the nozzle to cover the outlet passage and close the pressure chamber. Accordingly, pressurized gas is released from the pressure chamber to launch the vehicle by electrically disintegrating the seal. The nozzle also has an inlet conduit, communicating with the pressure chamber, that is sealed by a resilient valve flap to prevent back-flow of pressurized gas. The inlet conduit and valve flap are arranged to permit charging of the vehicle by placing it in a pressurized atmosphere.

7 Claims, 7 Drawing Figures

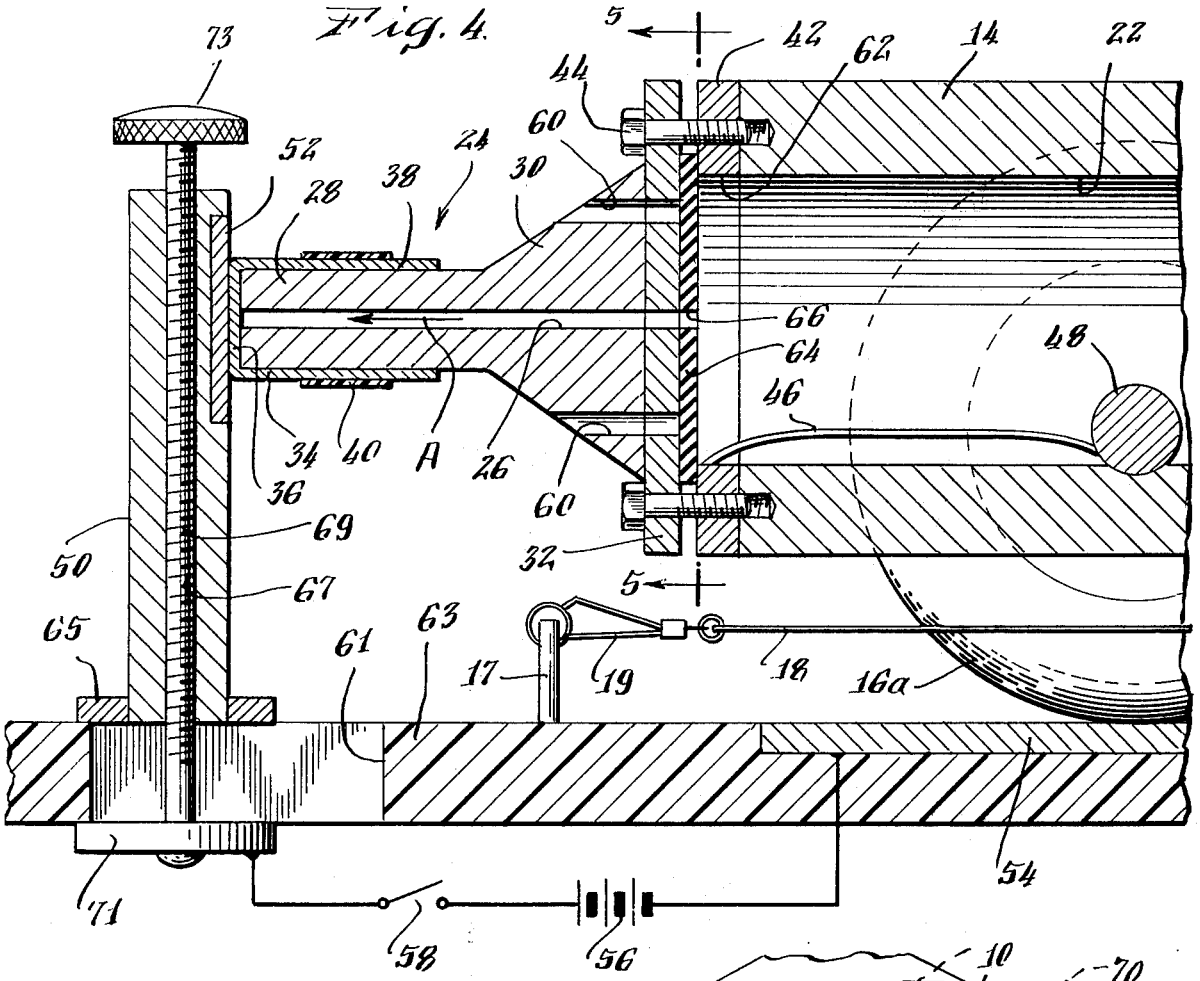
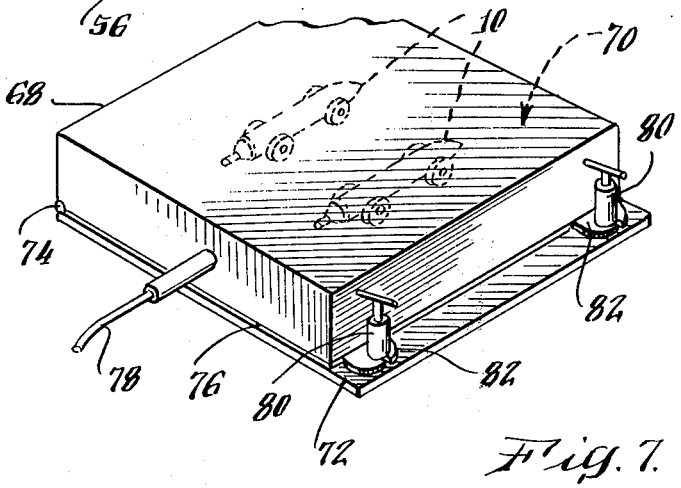
Fig. 7.
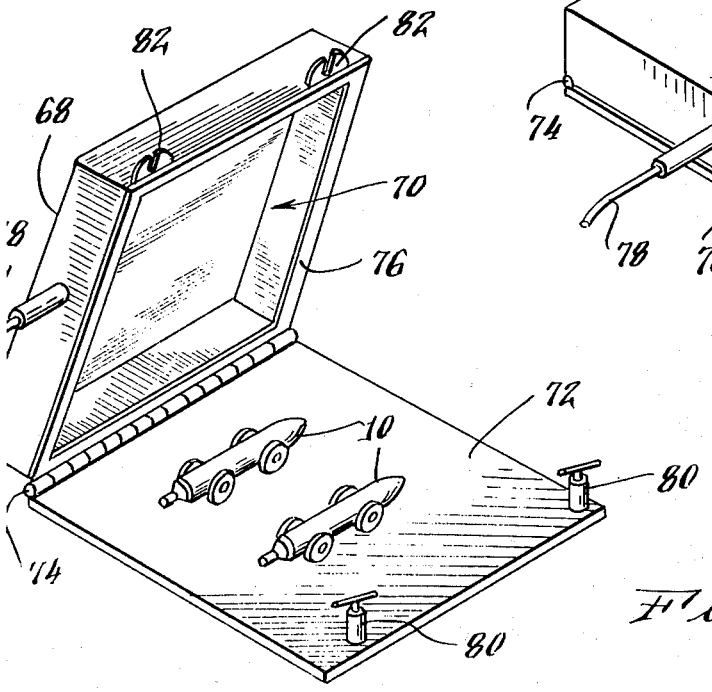
Fig. 6.

PRESSURIZED GAS DRIVEN VEHICLE AND METHODS FOR CHARGING AND LAUNCHING IT

BACKGROUND OF THE INVENTION

1. Field of the Invention

The present invention relates to a pressurized gas driven vehicle and, in particular, to a pressurized gas driven model racing automobile or the like.

Building and racing model automobiles, boats, airplanes and other similar vehicles have become popular pursuits in recent years for hobbyists and racing enthusiasts alike. Such activities appeal to those people who enjoy designing and building models and gain staisfaction from comparing, in head-to-head competition, their original vehicle designs with designs produced by others. Other people enjoy competition which requires that model vehicles be constructed to meet prescribed specifications and that modifications to vehicles be made within limited bounds. Refinements in details of design then become important. In the case of either type of competition, model building and racing provide useful and enjoyable recreation for many people.

Model racing vehicles of the type to which the present invention relates generally include a body which houses a pressure tank that is charged with compressed gas. The gas is released through an outlet orifice in one direction to drive the vehicle in the opposite direction by the familiar action-reaction principle of jet propulsion.

The compressed gas utilized is usually compressed air, but other pressurized gases, for example, pressurized carbon dioxide or nitrogen, steam under pressure or pressurized vapor can be employed. Accordingly, as used herein the terms "pressurized gas" or "compressed gas" are intended to be construed to include compressed air, steam, vapor or other pressurized gas or vapor. The term "gas" is to be interpreted to include any gas or mixture of gases such as air, steam or other vapor.

Pressurized gas propelled model racing vehicles are advantageously made to suddenly and freely open an outlet passage to suddenly and freely release stored pressurized gas and, thus, obtain maximum propulsive power. Furthermore, when many such vehicles are in competition, it is desirable to charge them with substantially equal pressures of compressed gas and to launch them simultaneously.

2. Description of the Prior Art

Vehicles propelled by pressurized gas are presently known.

For example, U.S. Pat. No. 3,577,677 (Bennett et al.) discloses a gravity actuated toy vehicle that includes a tank which may be filled with pressurized gas. An outlet is formed at the rear section of the tank and is closed by a tapered plug, hinged above the outlet. When a depending extension of the plug strikes a standing projection in the path of the vehicle, the plug is disengaged from the outlet to release the stored compressed gas. The tank also has an inlet through which it is filled with compressed gas. The inlet is closed by a spring biased check valve.

U.S. Pat. No. 2,410,682 (Richardson) and U.S. Pat. No. 2,545,586 (Pollak) disclose compressed gas propelled toy vehicles which have mechanical, hand-operated valves that close an outlet from a pressure chamber. The Richardson device includes a terminal having a hole communicating with the pressure chamber that is closed by a rotatable hand-operated disc having a similar hole registrable with the terminal hole. The Pollak device utilizes a spool-shaped cylindrical valve having a reduced diameter portion which, when transversely positioned in an outlet passage, permits release of compressed gas. An alternative embodiment contemplates puncturing an outlet seal with a hollow needle to release the compressed gas.

SUMMARY OF THE INVENTION

In a preferred embodiment of the present invention to be described below in detail, the pressurized gas driven vehicle comprises a nozzle having a jet outlet passage through it. An electrically conductive cover, which rapidly and completely disintegrates when sufficient electric current is passed through it, seals the outlet passage.

The nozzle is formed with an elongate, cylindrical section and the jet outlet passage is positioned to open through the rear planar wall of this section. The outlet passage cover is preferably a light gage, electrically conductive metal foil which is held over this rear wall and firmly sealed against the side cylindrical wall of the nozzle extension by a tightly fitted elastic band.

The pressurized gas driven vehicle further includes a body which defines a pressure chamber that opens at the rear of the vehicle. The nozzle is mounted on the body with its jet outlet passage in communication with the pressure chamber and positioned to release pressurized gas in a direction generally opposite to the vehicle's desired path of travel. Accordingly, the outlet passage cover seals both the outlet passage and pressure chamber to confine pressurized gas.

The vehicle is launched by connecting the jet outlet passage cover to a source of electric current sufficiently large to cause its disintegration. For example, the vehicle may be positioned with the metal foil cover touching two contacts that are in turn connected to a source of electric current.

The nozzle also includes at least one inlet passage sealed by a resilient flap check valve to prevent backflow of pressurized gas. The inlet and check valve are arranged so that the vehicle may be charged with pressurized gas when placed in an atmosphere of high pressure.

Vehicles constructed in accordance with the preferred embodiment of the present invention are particularly well suited to be launched simultaneously. The respective jet outlet passage covers of a number of vehicles may be connected in parallel in a single electrical circuit including a source of electrical current, which when turned on simultaneously disintegrates all of the passage covers. The inlet flap check valve arrangement also permits simultaneous charging of a number of vehicles with the same pressure of gas by placing all vehicles in a single atmosphere of higher pressure than that in the respective vehicle pressure chambers.

Accordingly, it is an object of the present invention to provide a pressurized gas driven vehicle which may be simultaneously launched with other vehicles embodying the invention and which may be charged easily with the same gas pressure.

Other objects, aspects, and advantages of the present invention will be pointed out in, or will be understood from the following detailed description considered together with the accompanying drawings.

BRIEF DESCRIPTION OF THE DRAWINGS

FIG. 4 is an enlarged vertical cross-sectional view of car number 74 taken on a vertical longitudinal plane with respect to FIG. 2 showing details of the nozzle and a suitable circuit for disintegrating the jet outlet passage cover.

FIG. 6 is a perspective view of suitable apparatus for charging more than one car constructed in accordance with the preferred embodiment of the present invention.

FIG. 7 is a second view of the charging apparatus shown closed over two cars during the charging process.

DETAILED DESCRIPTION OF THE PREFERRED EMBODIMENTS

Figure 1:
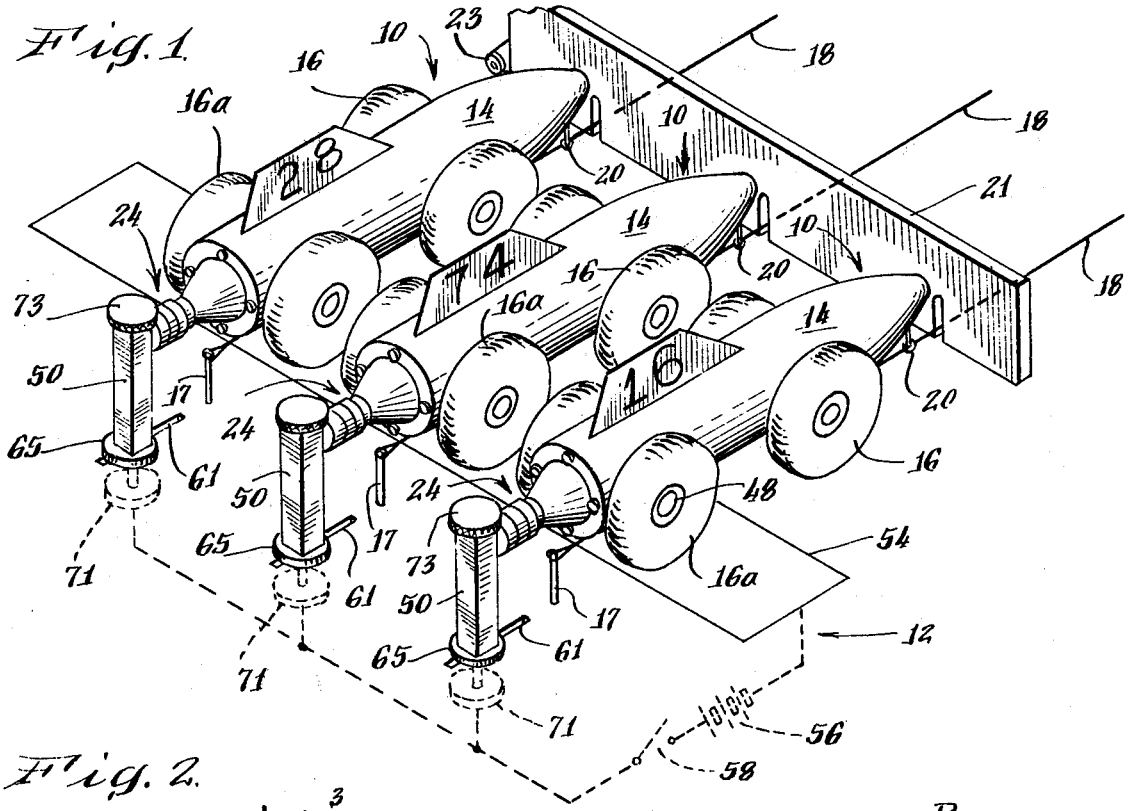
FIG. 1 is a perspective view of three compressed gas driven vehicles in the form of model racing cars, constructed in accordance with the preferred embodiment of the present invention. These cars are prepared to be simultaneously launched.

FIG. 1 illustrates three vehicles, in the form of model racing cars each generally indicated at 10, positioned at a launch site 12 and prepared to be launched simultaneously. However, the invention may be embodied in vehicles other than cars such as boats or as airplanes. Each car includes a body 14 mounted on four wheels 16.

A race course for each car 10 is determined by a cable 18, which may be, for example, a monofilament line that extends from the launch site to the terminus of the course. Each guide cable 18 originates at standard 17 to which it is attached by a suitable clasp 19 (FIG. 4). A ring hook 20 (FIGS. 2 and 3) mounted on the body 14 engages the cable in order to guide the car along the course. Alternatively, these cars 10 may be guided by any other suitable means or may be permitted to run freely without guidance.

Each of the vehicles 10 is positioned in line with all other vehicles by a starting positioner in the form of a movable barrier 21 pivoted on a hinge 23. At the beginning of each race, the vehicles are attached to their respective guide cables 18, the barrier 21 is lowered in front of them and each vehicle is positioned with its nose abutting the barrier 21. In this way, all vehicles start from the same position. Further, as will be explained in greater detail below, the launch site 12 is adapted to accomodate vehicles of varying lengths and, thus, permits diversity of vehicle design.

As shown in greater detail (FIGS. 2 and 3), body 14 is cylindrical and is provided with a hollow inner bore extending part way therethrough to define a pressure chamber 22. The body may be made from a readily available material such as a broomstick. A nozzle assembly, generally indicated at 24, is mounted on the rear of the body 14 to enclose pressure chamber 22. This nozzle assembly is provided with a jet outlet passage 26, shown in phantom lines in FIG. 2, through which pressurized gas is released. When released at high velocity through the jet outlet passage as indicated by arrows A, pressurized gas effects a leftward action which, in reaction, propels the car rightward as indicated by arrow B.

Figure 5:
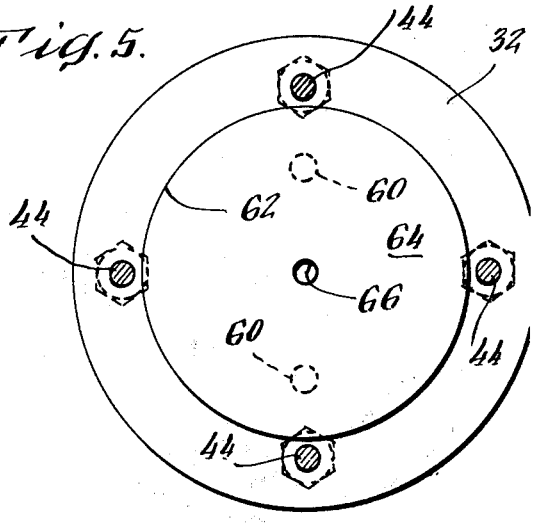
FIG. 5 is a vertical cross-sectional view taken through plane 5—5 in FIG. 4 looking leftward showing details of the resilient flap check valve.

Details of nozzle assembly 24 are best illustrated in FIGS. 4 and 5. This assembly includes a cylindrical nozzle extension 28 formed integrally with a conical section 30 that is attached to a face plate 32 by welding, adhesive, or any other suitable means. Face plate 32 is secured to a back-up plate 42 by a series of bolts 44. The back-up plate 42 is directly mounted on the rear of body 14 by suitable means like an adhesive such as an epoxy resin. Alternatively, face plate 32 may be directly secured to the body 14. The jet outlet passage 26 extends completely through the nozzle assembly to communicate with pressure chamber 22 and is sealed by a light gage, electrically conductive metal foil cover 34. The cover 34 encloses the end planar wall 36 of nozzle extension 28, drapes over the side cylindrical wall 38 of extension 28, and is tightly clamped thereto by an elastic band 40 of appropriate size.

The material from which metal foil cover 34 is made is electrically conductive and disintegratable when sufficient electric current is conducted through it. For example, it has been found that light gage magnesium foil or aluminum foil is suitable for this component.

The car 10 is launched when metal foil cover 34 is rapidly disintegrated by conducting sufficient electric current through it, thereby releasing pressurized gas stored in pressure chamber 22. This permits compressed gas to freely exhaust through the unobstructed outlet passage 26.

Figure 2:
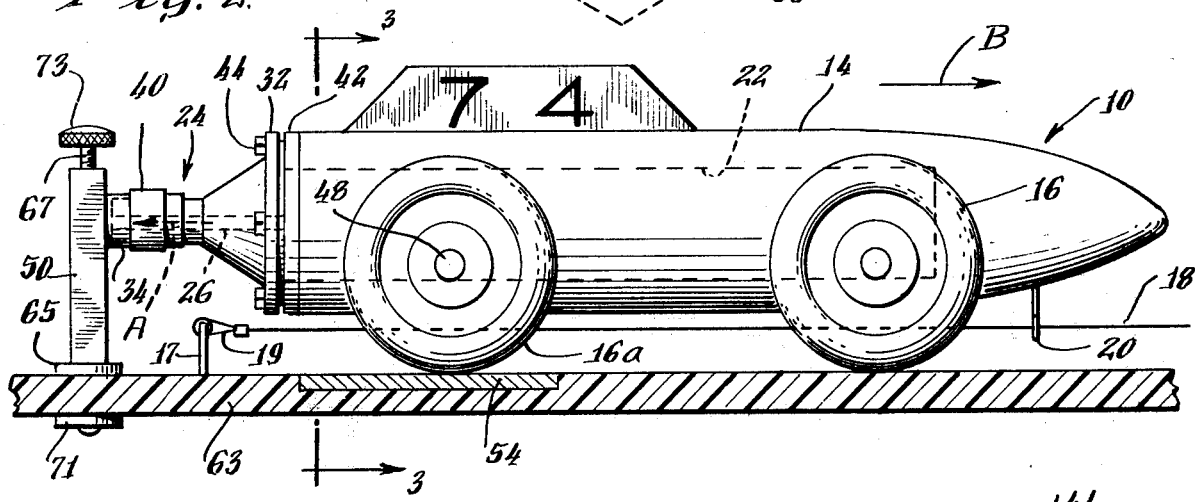
FIG. 2 is a side elevational view of car number "74" illustrated in FIG. 1 immediately prior to launch.
Figure 3:
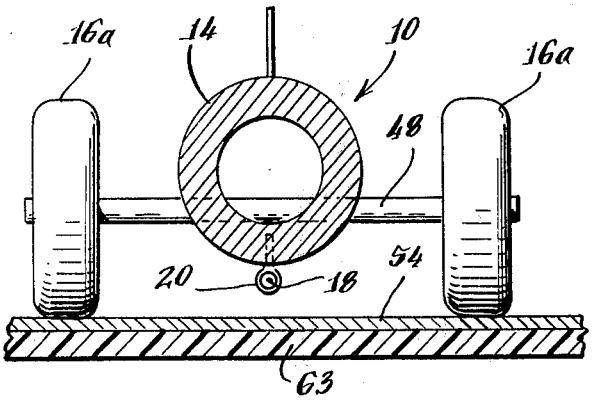
FIG. 3 is a vertical cross-sectional view taken through plane 3—3 in FIG. 2 looking rightward of the body of this car.

Cars 10 are constructed to be operated in conjunction with electrical launch apparatus illustrated in FIGS. 1, 2, and 4, to disintegrate metal foil cover 34. In particular, the nozzle assembly including the integrally formed nozzle extension 28 and conical portion 30, face plate 32, bolts 44, and back-up plate 42, are made of electrically conductive materials, for example, copper or steel. The back-up plate 42 is connected by a wire conductor 46 to the rear axle 48, also made of conductive material. Rear wheels **16*a* are made of a conductive material such as commercially available conductive rubber. These wheels 16*a* are mounted on and electrically connected to axle 48 by suitable conductive bearings (not shown) or by a direct mounting arrangement. Accordingly, a complete electrically conductive path is made through wheels 16*a*, axle 48, wire conductor 46, back-up plate 42, bolts 44, face plate 32, and nozzle conical portion 30 and extension 28 to the metal foil cover 34**.

The launch apparatus includes an upstanding post 50 in which a permanent magnet 52 is mounted. Magnet 52 is disposed at height to directly contact metal foil cover 34 and to lightly hold nozzle 24 and, hence, the whole car 10 in the launch position. An electrically conductive surface is positioned to contact conductive wheels **16*a* when car 10 is positioned at the launch site and metal foil cover 34 is in contact with magnet 52. Surface 54 and magnet 52 are connected to a source 56 of electrical current by a switch 58. Accordingly, car 10 is launched when positioned at the launch site, with its conductive rear wheels 16*a* in contact with the surface 54 and its metal foil cover 34 in contact with magnet 52, by closing switch 58. The thrust created by the release of compressed gas is sufficient to break the magnetic bond between magnet 52 and nozzle 24**.

As can be seen in FIG. 1, each of a number of individual launch apparatus may be connected in parallel with the source of electrical current and operated through a single switch to simultaneously launch a number of model cars 10. Further, each launch site is constructed to accomodate cars of various lengths. A suitable arrangement for permitting such adjustment is shown in detail in FIGS. 2 and 4. The upstanding post 50 is positioned in an elongate slot 61, formed in the surface 63 of the launch site 12. A flange 65, larger than slot 61, is fixed to the base of post 50, and threaded rod 67 is tapped into a thread bore 69 that runs through post 50. A washer 71 is carried at the bottom of rod 67 and a knurled knob 73 is carried at the top. Accordingly, post 50 may be adjusted in slot 61 and subsequently fixed in the desired position by turning knob 73 to clamp surface 63 between washer 71 and flange 65. However, adjustment means alternative to those described may be provided, if desired.

Note that, as shown in FIG. 4, the rod 67, washer 71, and post 50 are electrically conductive to complete the circuit from switch 58 to magnet 52.

After each launch, the cars may be prepared for another race by replacing the disintegrated metal foil cover. This is easily done by removing elastic band 40, installing a new cover 34, and replacing band 40.

The pressurized gas driven vehicle of the present invention is also constructed to be charged with compressed air by being placed in an atmosphere of high pressure. As shown in FIGS. 4 and 5, nozzle assembly 24 is also provided with two inlet conduits 60 bored through conical postion 30 and face plate 32. Back-up plate 42 is formed with an aperture 62 of large enough diameter to permit inlet conduits 60 to open into pressure chamber 22. A disk-shaped resilient flap check valve 64 is sandwiched between back-up plate 42 and face plate 32 by bolts 44 and may be sealed at its outer edges to either face plate 32 or back-up plate 42. Further, check valve 64 has a central aperture 66 which permits jet outlet passage 26 to communicate with pressure chamber 22.

The portions of resilient flap check valve 64 which overlie the mouths of inlet conduits 60 are not sealed to face plate 32. Accordingly, pressurized gas may enter inlet conduits 60, pass between face plate 32 and check valve 64, and enter pressure chamber 22 through aperture 66 when the ambient pressure about cars 10 exceeds the pressure in the pressure chamber 22. However, when gas pressure inside pressure chamber 22 exceeds the ambient pressure, check valve 64 closes back against the mouths of inlet conduits 60.

Apparatus for simultaneously charging a number of vehicles such as those described above is illustrated in FIGS. 6 and 7. This apparatus includes a housing 68 which defines a chamber 70 large enough to accomodate the number of cars which are desired to be simultaneously charged. The housing is mounted to pivot upwardly from a smooth surface 72 on a hinge 74. Further, a resilient seal 76 is mounted about the edge of the bottom open mouth of housing 68 to tightly seal against smooth surface 72. Chamber 70 is connected by a hose 78 to a source of compressed gas (not shown).

Cars 10 are charged by lowering housing 68 over them as shown in FIG. 7. Cooperating wing bolts 80 and U-shaped couplings 82 clamp and seal the housing tightly against the smooth surface. Pressurized gas is introduced into the closed chamber 70 formed by housing 68 and smooth surface 72 through hose 78. Since the inlet conduit and resilient flap check valve arrangement permits all cars to be charged with pressurized gas having pressure equal to the ambient pressure, all cars enclosed in chamber 70 are charged to the pressure introduced therein.

Although specific embodiments of the pressurized gas driven vehicle and methods for launching and charging it have been disclosed above in detail, it is to be understood that this is for purposes of illustration. Modifications may be made to the described structure and methods to adapt this compressed air powered vehicle to particular applications without departing from the scope of the following claims.

What is claimed is:

1. A pressurized gas driven vehicle comprising:

a body defining a pressure chamber;

inlet conduit means for conducting pressurized gas to said pressure chamber;

a jet outlet passage communicating with said pressure chamber, and being positioned to direct pressurized gas flowing therethrough in a direction generally opposite to the desired path of said vehicle; and electrically conductive jet outlet passage cover means, disintegratable when electric current is conducted through it, for sealing said outlet passage prior to being disintegrated and for rapidly releasing pressurized gas stored in said pressure chamber through said outlet passage to propel said vehicle when disintegrated by electric current conducted through it.

2. The pressurized gas driven vehicle as claimed in claim 1 wherein said jet outlet passage cover means includes a cover of electrically conductive, disintegratable, metal foil mounted to close said outlet passage.

3. The pressurized gas driven vehicle as claimed in claim 2 wherein said vehicle further comprises:

an elongate nozzle mounted on said body, said outlet passage being disposed through said nozzle; and wherein said jet outlet passage cover means further comprises means for attaching said metal foil cover to said nozzle to close said outlet passage.

4. The pressurized gas driven vehicle as claimed in claim 3 wherein at least a portion of said metal foil overlies the elongate section of said nozzle and wherein said attaching means comprises:

an elastic band for clamping said overlying metal foil portion to the elongate section of said nozzle means.

5. The pressurized gas driven vehicle as claimed in claim 1 wherein said vehicle is a car and further comprises:

at least one wheel for supporting said car, said wheel being electrically conductive, and conductor means for electrically connecting said conductive wheel to said cover means whereby electric current can be conducted through said cover means by connecting a source of electric current to said conductive wheel and said cover means.

6. A pressurized gas driven vehicle comprising:

a body defining a pressure chamber;

nozzle means mounted on said body having inlet conduit means communicating with said pressure chamber to conduct pressurized gas thereto, said nozzle means also having jet outlet passage means communicating with said pressure chamber and being positioned to direct pressurized gas flowing therethrough in a direction generally opposite to the desired path of said vehicle, valve means for checking back-flow of pressurized gas through said inlet conduit means; and electrically conductive jet outlet passage cover means, disintegratable when electric current is conducted through it, attached to said nozzle means for sealing said outlet passage means prior to being disintegrated and for rapidly releasing pressurized gas stored in said pressure chamber through said outlet passage means to propel said vehicle when disintegrated by electric current conducted through it.

7. The pressurized gas driven vehicles as claimed in claim 6 wherein said check valve means comprises;

a resilient sealing flap mounted on said nozzle means interiorly of said pressure chamber to cover said inlet conduit means, whereby flow of pressurized gas into said pressure chamber tends to open said sealing flap and pressurized gas stored in said pressure chamber tends to close said sealing flap.

* * * * *